US006171085B1

(12) United States Patent
Iwasa

(10) Patent No.: US 6,171,085 B1
(45) Date of Patent: Jan. 9, 2001

(54) COMPRESSOR HAVING A FRONT CASING AND A REAR COVER

(75) Inventor: Makoto Iwasa, Shiga (JP)

(73) Assignee: Matsushita Electric Industrial Co., Ltd., Osaka (JP)

( * ) Notice: Under 35 U.S.C. 154(b), the term of this patent shall be extended for 0 days.

(21) Appl. No.: 09/340,995

(22) Filed: Jun. 28, 1999

(30) Foreign Application Priority Data

Oct. 5, 1998 (JP) ..... 10-282445

(51) Int. Cl.[7] ..... F04C 18/04; F04C 27/00
(52) U.S. Cl. ..... 418/55.1; 418/55.4
(58) Field of Search ..... 418/55.1, 69, 149, 418/270, 55.4; 417/360; 29/888.022

(56) References Cited

U.S. PATENT DOCUMENTS 4,432,708 * 2/1984 Hiraga et al. ..... 418/55.1
4,484,869 11/1984 Nakayama et al. ..... 418/55.6
5,954,489 * 9/1999 Kinoshita ..... 418/270

FOREIGN PATENT DOCUMENTS

354332 * 6/1961 (CH) ..... 418/270
3114040 * 2/1982 (DE) ..... 418/270
507626 * 12/1954 (IT) ..... 418/270
63-158594 10/1988 (JP) .
4-143477 * 5/1992 (JP) ..... 418/55.1
7-332266 12/1995 (JP) .
9-203388 5/1997 (JP) .

* cited by examiner

*Primary Examiner*—John J. Vrablik
(74) *Attorney, Agent, or Firm*—Ratner & Prestia

(57) ABSTRACT

A compressor which can be easily mounted on a vehicle or the like is presented. It includes a front casing having a bottom and an opening, and a rear cover placed to seal the opening. The front casing has a mounting penetration hole placed in the bottom, a base for mounting outside, a suction port for sucking a refrigerant, and a discharge port for discharging the refrigerant. A shaft exposed outside from the mounting penetration hole, a movable scroll allowed to swivel by rotation of the shaft, and a fixed scroll having a discharge hole are placed in the front casing. The refrigerant enters from the suction port, and is compressed by the movable scroll and fixed scroll, and is discharged from the discharge hole into the discharge chamber formed by the fixed scroll and rear cover, and is discharged from the discharge chamber through the discharge port.

9 Claims, 5 Drawing Sheets

COMPRESSOR HAVING A FRONT CASING AND A REAR COVER

FIELD OF THE INVENTION

The present invention relates to a compressor, and more particularly to a compressor of an air conditioner used in automobile and other vehicles.

BACKGROUND OF THE INVENTION

A conventional scroll compressor (hereinafter abbreviated as compressor) comprises, as shown in FIG. 4, a rear casing 32 having an opening at the front side, and a front cover 31 placed in its opening. A movable scroll 34, a fixed scroll 39, and a rotation preventive mechanism 36 are disposed in the rear casing 32. An outer circumference of the fixed scroll 39 contacts with an inner circumference of the rear casing 32. The movable scroll 34 is placed between the front cover 31 and the fixed scroll 39 in order to swivel while contacting with the surface of the fixed scroll 39. The rotation preventive mechanism 36 is placed between the movable scroll 34 and the front cover 31 in order to allow the swivel motion only while preventing rotation of the movable scroll 34. A suction chamber 46 for sucking a refrigerant and a discharge chamber 47 for discharging the refrigerant are mutually partitioned through the fixed scroll 39. A suction port 32*c* for sucking the refrigerant is formed in an outer wall of the rear casing 32 of the suction chamber 46. A discharge port 32*d* for discharging the refrigerant is formed in the outer wall of the rear casing 32 of the discharge chamber 47. A seal mechanism having an O-ring 41 is placed between the inner circumference 32*a* of the rear casing 32 and the fixed scroll 39. This seal mechanism seals between the fixed scroll 39 and the rear casing 32. It is thus completely sealed between the suction chamber 46 and discharge chamber 47. A plurality of mounting bases 32*b* for mounting on a vehicle or other mechanical structure are integrally disposed on the outer wall of the rear casing 32. The front cover 31 has a clutch mounting section 31*c*. A shaft 40 is installed so as to cooperate with the movable scroll 34, and this shaft 40 penetrates through the clutch mounting section 31*c*, and has its leading end exposed outside. An electromagnetic clutch 38 is installed outside of the clutch mounting section 31*c*, and is coupled to the shaft 40. The front cover 31 is coupled to the rear casing 32 through a seal member 45, by using bolt 44 or other bonding member. The seal member 45 seals between the front cover 31 and rear casing 32, and by this seal member 45, the suction chamber 46 and the outside are completely isolated. Thus, a pressure vessel sealing between the suction pressure and atmospheric pressure was constituted.

Generally, when mounting a compressor of an air compressor on a vehicle, it is required to be high in the precision of pitch of the plurality of the mounting bases 32*b* of the compressor main body, precision of alignment of electromagnetic clutch, precision of discharge port and suction port pitch, and precision between these adjacent elements. In such conventional compressor, however, the front cover 31 having the mounting section 31*c* for the electromagnetic clutch 38 is composed of a separate part from the rear casing 32 having the plurality of mounting bases 32*b*, suction port 32*c* and discharge port 32*d*. Accordingly, the both parts of the front cover 31 and rear casing 32 must be heightened in the precision, including the machining tolerance in both axial direction and rotating direction and tolerance in assembling. The invention presents a compressor easily matched with the requirements of the vehicle to be used.

SUMMARY OF THE INVENTION

The compressor of the invention comprises a front casing having an opening at the rear part, and a rear cover disposed so as to seal the opening. The front casing includes a bottom, a side wall, a base for mounting the compressor outside, and a suction port for sucking a refrigerant. A compression unit is disposed in the front casing. A shaft coupled to the compression unit is exposed outside from a mounting penetration hole.

Preferably, the compression unit has a fixed scroll and a movable scroll. The movable scroll swivels by rotation of the shaft. The fixed scroll has a discharge hole. The bottom, side wall, and fixed scroll form a suction chamber. The fixed scroll and rear cover form a discharge chamber. The refrigerant enters the suction chamber through a suction port, and is compressed by the movable scroll and fixed scroll. The compressed refrigerant is discharge into the discharge chamber through the discharge hole, and is discharged from the discharge chamber through the discharge port.

Preferably, the front casing integrally includes a discharge port for discharging the refrigerant.

Preferably, comprising a first seal mechanism and a second seal mechanism, the first seal mechanism is placed among the front casing, fixed scroll and rear cover, and seals between the suction pressure and discharge pressure. The second seal mechanism is placed between the rear cover and the front casing, and seals between the discharge pressure and atmospheric pressure.

Preferably, it further comprises a rotation preventive mechanism accommodated in the front casing, for allowing the movable scroll to swivel only while preventing rotation. The movable scroll is engaged with the fixed scroll, and is allowed to swivel only by the rotation preventive mechanism, and the refrigerant is compressed by the swivel motion of the movable scroll and the fixed scroll.

Preferably, it further comprises an electromagnetic clutch disposed outside of the bottom of the front casing and coupled to the shaft.

Preferably, the rear cover has a hole formed in the outer circumference, and a space serving as passage of the refrigerant is formed between this outer circumference and the inner circumference of the front casing.

Preferably, the front casing has a step so that the diameter of a first fitting portion of the rear cover and front casing may be larger than the diameter of a second fitting portion of the fixed scroll and front casing.

In this constitution, the mounting penetration hole, mounting base, and suction port are provided integrally in the front casing. Accordingly, by controlling only the machining precision of the front casing, the precision of alignment of electromagnetic clutch, precision of pitch of mounting bases, and precision of pitch of suction port and discharge port may be matched with the specification of the vehicle, so that it can be mounted easily and accurately on the vehicle or other external apparatus.

BRIEF DESCRIPTION OF THE DRAWINGS

FIG. 2 (*b*) is a sectional view of a fixed scroll alone constituted in FIG. 1.

DETAILED DESCRIPTION OF THE INVENTION

Figure 1:
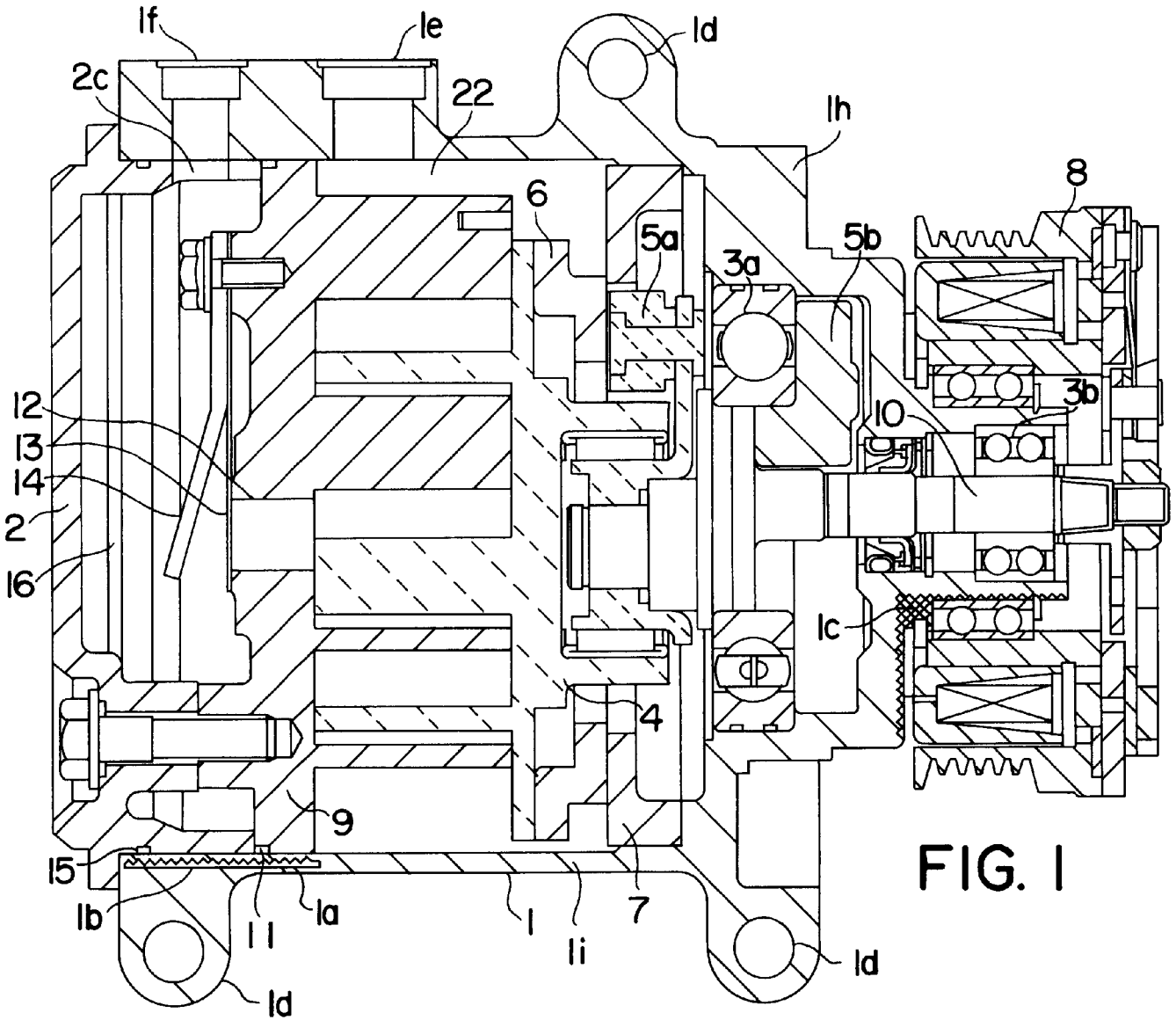
FIG. 1 is a longitudinal sectional view of a compressor in a first embodiment of the invention.

The compressor of the invention comprises a front casing having an opening, and a rear cover disposed to cover this opening. The front casing integrally includes a mounting penetration hole for mounting a shaft, a mounting base for mounting on a vehicle or the like, a suction port for sucking a refrigerant, and a discharge port for discharging it. A compression unit is installed in the front casing. The compression unit includes, for example, a movable scroll, a fixed scroll, a shaft, and a rotation preventive mechanism. The shaft is disposed as being coupled to the compression unit, and penetrates through the mounting penetration hole, and the leading end of the shaft is exposed outside of the front casing. An electromagnetic clutch is coupled to this leading end of the shaft. The rotation preventive mechanism plays the role of preventing rotation of the movable scroll, by the rotation of the shaft, and allowing only to swivel. The movable scroll is allowed to swivel only by the rotation preventive mechanism. The fixed scroll is disposed so as to be engaged with the movable scroll. By the swivel motion of the movable scroll, the refrigerant sucked in from the suction port is compressed. The rear cover is fitted to the front casing from the outside of the opening of the front casing. At the same time, the first seal mechanism installed among the front casing, fixed scroll and rear cover seals between the suction pressure and discharge pressure. Further, the second seal mechanism installed between the rear cover and the front casing seals between the discharge pressure and atmospheric pressure. Thus, the pressure vessel is constituted.

The refrigerant compressed by the movable scroll and fixed scroll is discharged into the discharge chamber composed of the fixed scroll and rear cover, from the discharge hole provided in the middle of the fixed scroll in the axial direction, and it is further discharged from this discharge chamber through the discharge port provided in the outer wall of the front casing.

In this constitution, accordingly, by controlling only the machining precision of the front casing, precision of pitch of the plurality of mounting bases, the precision of alignment of electromagnetic clutch, and precision of pitch of suction port and discharge port may be matched with the specification of the vehicle, so that the scroll compressor can be mounted easily and accurately on the vehicle or the like.

Preferably, the rear cover has at least one hole in the outer circumference, and a space serving as passage of discharged refrigerant is formed between the outer circumference of the rear cover and the inner circumference of the front casing. Further, only the mounting pitch is matched when tightening the rear cover and front casing.

In this constitution, in a specification varied in the position of discharge port, the rear cover can be used commonly when mounting the rear cover on the front casing.

Typical embodiments of scroll compressor of the invention are described below while referring to the accompanying drawings.

Exemplary Embodiment 1

FIG. 1 is a longitudinal sectional view showing an assembled state of a scroll compressor in a first embodiment. In FIG. 1, the scroll compressor comprises a front casing 1 in a cup shape having a bottom 1*h,* side wall 1*i* and opening, and a rear cover 2 disposed at the rear opening of the front casing 1. A compression unit having a shaft 10, a movable scroll 4, a fixed scroll 9, a rotation preventive mechanism 6, and a slot plate 7 is installed in the front casing 1. A shaft 10 has a leading end exposed to outside from the front bottom of the front casing. The movable scroll 4 is allowed to swivel by rotation of the shaft 10. The fixed scroll 9 has a discharge hole 12. The rotation preventive mechanism 6 has an Oldham's ring, and plays a role of permitting only the swivel motion of the movable scroll 4 while preventing its rotation. The slot plate 7 holds the Oldham's ring 6. Bearings 3*a,* 3*b* for supporting the rotation of the shaft 10 are disposed around the shaft 10. Balancers 5*a,* 5*b* coupled to the shaft 10 for canceling the imbalance of the movable scroll 4 are disposed in the front casing 1.

An electromagnetic clutch 8 is fitted to the leading end of the shaft 10. The electromagnetic clutch 8 transmits rotation of the engine of an automobile or the like, and turns on or off the operation of the compressor as required.

The front casing 1 has a first fitting portion 1*a* fitted to the fixed scroll 9, and a second fitting portion 1*b* fitted to the rear cover 2 on its inner circumference. The front casing 1 includes also a mounting penetration hole 1*c,* a plurality of mounting bases 1*d,* a suction port 1*e,* and a discharge port 1*f.* The electromagnetic clutch 8 is coupled to the shaft 10, and is disposed outside of the bottom 1*h.* The plurality of mounting bases 1*d* are attached to a vehicle or other mechanical structure. Refrigerant is sucked into a suction chamber 22 through the suction port 1*e.* The refrigerant is discharged into an external refrigeration cycle through the discharge port 1*f.* The mounting penetration hole 1*c,* plurality of mounting bases 1*d,* suction port 1*e,* and discharge port 1*f* are integrally formed mutually. The rear cover 2 is disposed so as to enclose the opening of the front casing 1. The suction chamber 22 is formed as being surrounded by the bottom 1*h* and fixed scroll 9. The discharge chamber 16 is formed as being surrounded by the rear cover 2 and fixed scroll 9.

Figure 2:
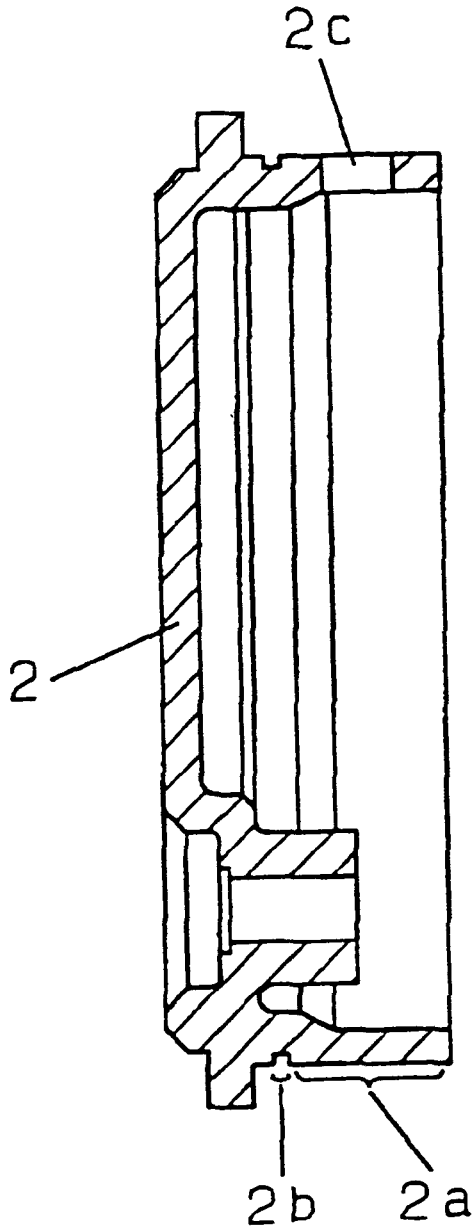
FIG. 2 (*a*) is a sectional view of a rear cover alone constituted in FIG. 1.
Figure 2:
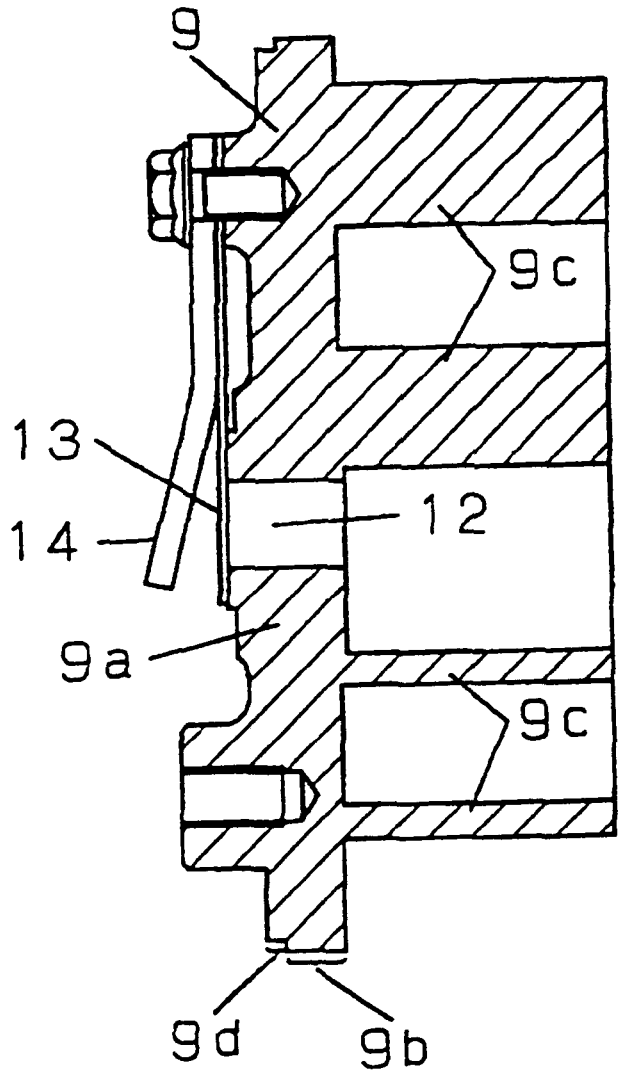

FIG. 2 (*b*) is a sectional view of the fixed scroll alone. The fixed scroll 9 has an end plate 9*a* and blades 9*c.* The outer surface 9*b* of the end plate 9*a* is fitted to the first fitting portion la of the front casing 1. The blade 9*c* has a spiral shape to be engaged with the movable scroll 4. The end plate 9*a* has a first seal portion 9*d* adjacent to the outer surface 9*b.* As a first seal mechanism, an O-ring 11 is disposed in the first seal portion 9*d.* The first seal mechanism 11 plays a role of sealing between the suction pressure and discharge pressure. The first seal mechanism 11 is composed of synthetic rubber, natural rubber, plastic, organic material, or the like. A discharge hole 12 is provided nearly in the center of the end plate 9*a.* The discharge hole 12 is opened or closed by the discharge valve 13 and valve retainer 14. The discharge chamber 16 is formed as being enclosed by the rear cover 2 and the end plate 1*a* of the fixed scroll 9. The gas as refrigerant is sucked into the suction chamber 22 from the suction port 1*e.* The refrigerant is compressed by the fixed scroll 9 and the movable scroll 4 in the suction chamber 22. The compressed refrigerant is discharged into the discharge chamber 16 through the discharge hole 12.

FIG. 2 (*a*) is a sectional view of a rear cover alone. The rear cover 2 has a third fitting portion 2*a,* a second seal portion 2*b,* and a hole 2*c* formed on the outer circumference. The third fitting portion 2*a* is disposed adjacently to the second seal portion 2*b,* and is fitted into the second fitting portion 1*b* of the front casing 1. As a second seal mechanism, an O-ring 15 is fitted to the second seal portion 2. The second seal mechanism 15 has a role of completely dividing the discharge chamber 16 from the outside, and has a role of sealing between the discharge pressure and atmospheric pressure. The hole 2*c* is formed in the outer surface of the rear cover 2 so as to coincide with the position of the discharge port 1*f* shown in FIG. 1 through the discharge chamber 16.

Herein, the refrigerant compressed by the movable scroll 4 and fixed scroll 9 flows into the discharge chamber 16 through the discharge hole 12, and passes through the hole 2*c* in the rear cover 2, and is guided into the discharge port 1*f* and discharged into the refrigeration cycle.

A plurality of mounting bases 1*d* are attached to the mechanical section of the vehicle. The suction port 1*e* and discharge port 1*f* are joined to other parts of the air conditioner. The electromagnetic clutch 8 is fitted to other mechanical section of the vehicle. Thus, all positions of the plurality of mounting bases 1*d,* suction port 1*e,* discharge port 1*f,* and electromagnetic clutch 8 are mounted on the mechanical sections of the vehicle.

In this constitution, the mounting penetration hole 1*c,* plurality of mounting bases 1*d,* suction port 1*e,* and discharge port 1*f* can be provided integrally on the front casing 1. Without depending on the assembling tolerance as in the prior art, in this constitution, only by the assembling precision of the front casing alone, the scroll compressor can be mounted easily, securely and precisely according to the specification of the vehicle. Further, if the mounting specification is changed, only by control of change of processing of the front casing, the scroll compressor having the required specification can be presented at low cost.

In the embodiment, the discharge port is formed in the front casing 1, but instead of such constitution, the discharge port may be also formed in the rear cover. In such constitution, a better effect than in the prior art is obtained. But this effect is slightly inferior to the above effect.

Exemplary Embodiment 2

Figure 3:
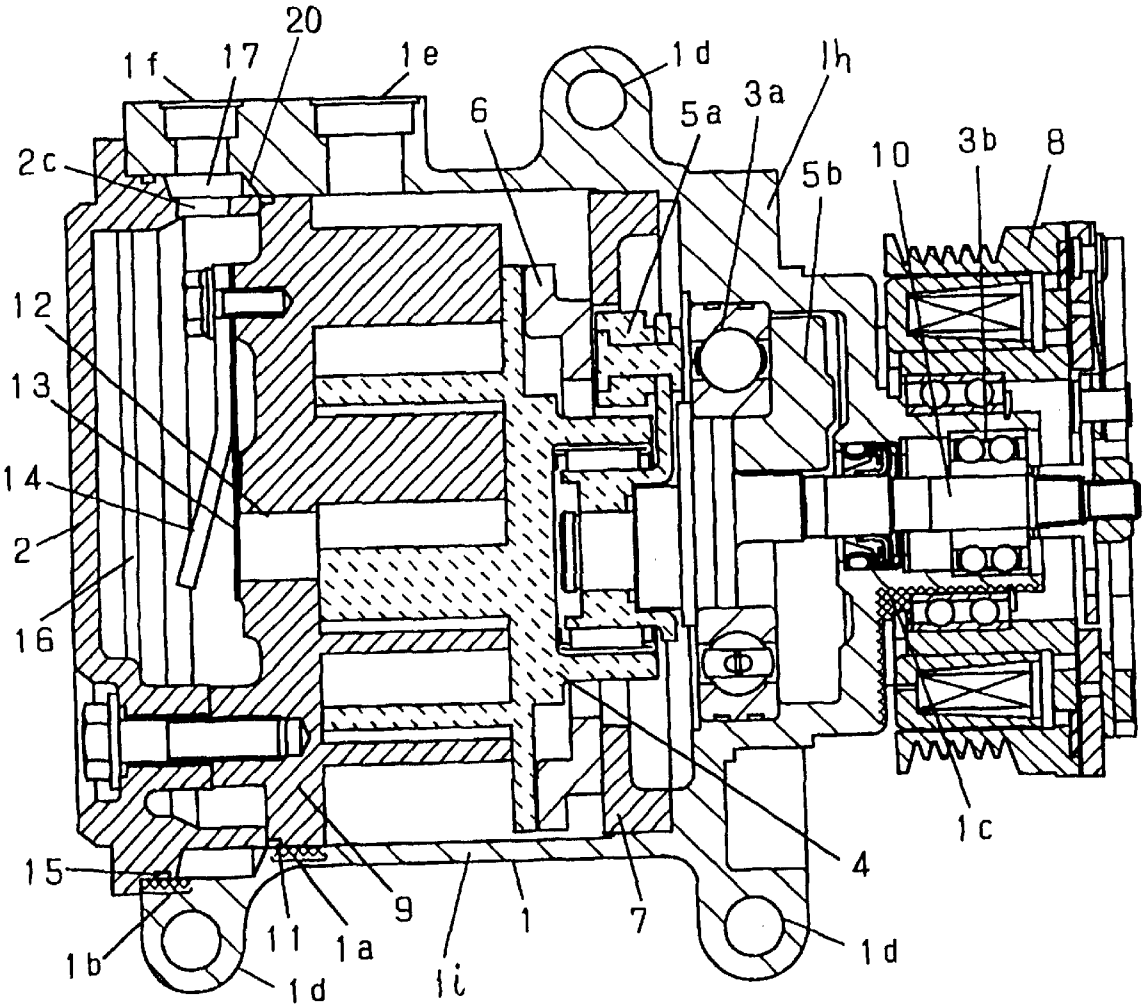
FIG. 3 is a longitudinal sectional view of a compressor in a second embodiment of the invention.
Figure 4:
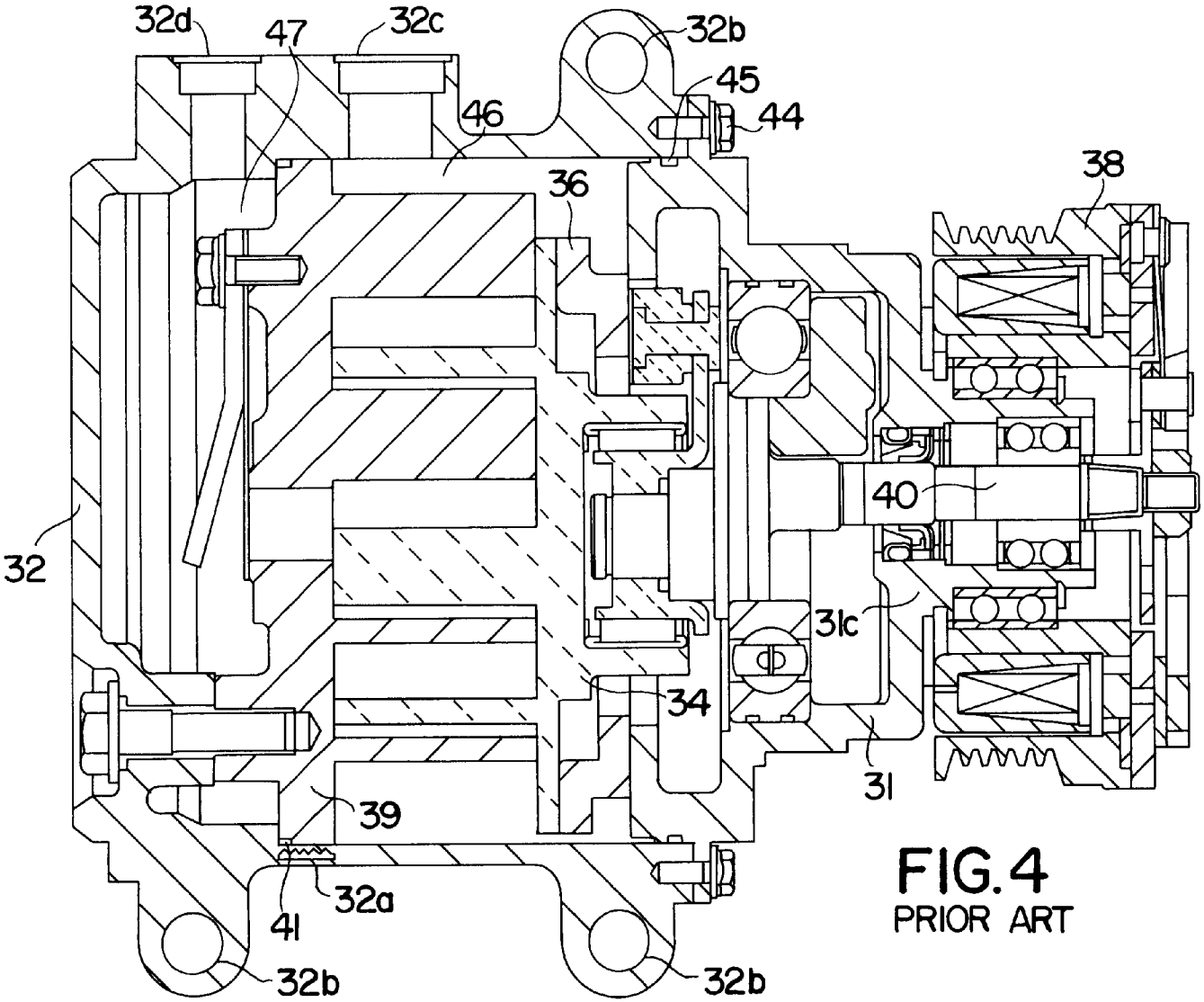
FIG. 4 PRIOR ART
FIG. 4 is a longitudinal sectional view of a conventional scroll compressor.

FIG. 3 is a longitudinal sectional view showing an assembled sate of a compressor in a second embodiment of the invention. The constituent of parts is same as in the first embodiment shown in FIG. 1, FIG. 2 (*a*) and FIG. 2 (*b*), and detailed description is omitted.

In this embodiment, a front casing 1 a step 20 so that the diameter of a second fitting portion 1*b* of the front casing 1 fitting to a rear cover 2 may be larger than the diameter of a first fitting portion 1*a* fitting to a fixed scroll 9. A space 17 is formed between the front casing 1 and the rear cover 2, between a first seal mechanism 11 and a second seal mechanism 15. The space 17 has a role of serving as a passage of refrigerant. The refrigerant is guided into a discharge port 1*f* through a hole 2*c* from the discharge chamber 16.

In this constitution, in addition to the effects in the first embodiment, the following effects are obtained. Since the space 17 is present from a discharge chamber 16 to the discharge port 1*f,* the position of the hole 2*c* on the outer circumference of the rear cover 2 is not always required to coincide with the discharge port 1*f,* and it may be formed at any arbitrary position. When assembling a compressor, it is required only to match the tightening pitch when mounting the front casing 1 and rear cover 2. Therefore, it is easy to assemble the compressor. Moreover, in the event of change of position of discharge port due to design of the vehicle to be used, the rear cover may be used commonly without changing the specification of the rear cover.

In the scroll compressor of the embodiment, the compression unit comprises a fixed scroll and a movable scroll, but not limited to this constitution, the same effects are obtained in the compressor having other constitution. However, the best effects are obtained in the scroll compressor comprising a fixed scroll and a movable scroll. The invention is characterized by changing the diameter of the first fitting portion 1*a* and second fitting portion 1*b* of the front casing 1, but not limited to this constitution, it is also possible to composed by forming a concave groove, a step or a gap in a tubular third fitting portion 2*a* (outer circumference) of the rear cover 2. In such constitution, the same effects as above are obtained.

Figure 5:
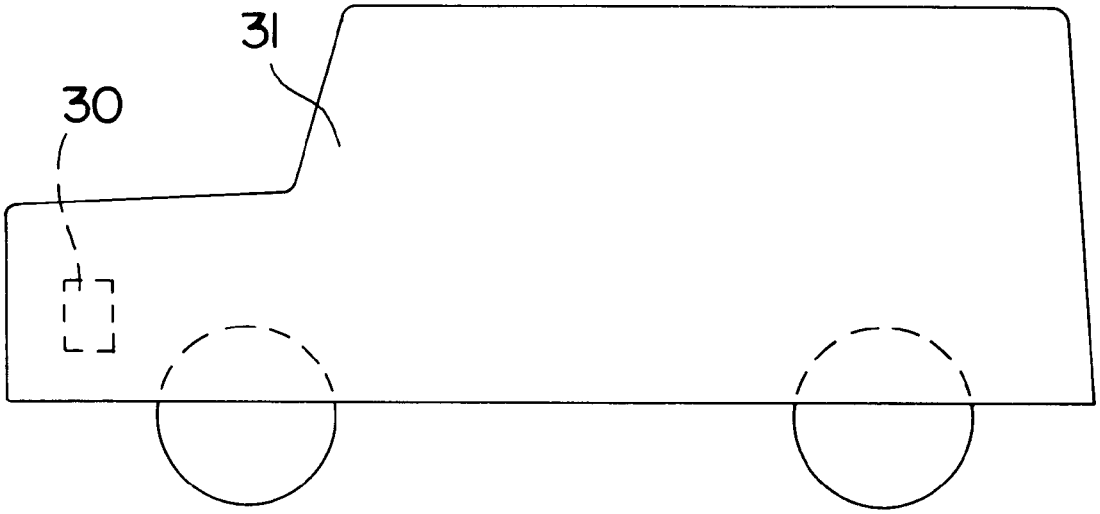
FIG. 5 is a scroll compressor fixed to a vehicle

Thus, since the clutch mounting section, plurality of mounting bases, and suction port are integrally installed in the front casing, the precision of the front casing such as the pitch of the plurality of mounting bases and pitch of suction port and discharge port may be easily adjusted by machining according to the required specification, so that it is easy to mount the scroll compressor 30 on a vehicle 31 accurately and precisely. The feature of the vehicle 31 having the scroll compressor 30 is shown at FIG. 5.

Moreover, the electromagnetic clutch can be placed on the shaft at accurate precision, so that the electromagnetic clutch may be aligned at high precision.

Furthermore, by forming a hole in the outer circumference of the rear cover and a space between its outer circumference and inner circumference of the front casing, the refrigerant in the discharge chamber is guided into the discharge port through the hole and the space. As a result, even in the compressor in the specification changed in the position of the discharge port and rear cover hole, preferably, the rear cover can be used commonly.

What is claimed is:

1. A compressor for compressing refrigerant comprising:

(a) a front casing having an opening, a bottom and a side wall, said front casing having
a mounting penetration hole formed in said bottom,
a mounting base, and
a suction port for sucking said refrigerant, (b) a rear cover placed to seal said opening, (c) a compression unit placed in said front casing, and (d) a shaft penetrating from said front casing through said mounting penetration hole and protruding therefrom, wherein said compression unit has a fixed scroll placed at said opening side in said front casing, and a movable scroll placed between said bottom of said front casing and said fixed scroll for swiveling in cooperation with said shaft, and wherein said front casing further has a discharge port for discharging said refrigerant.

2. A compressor of claim 1, further comprising an electromagnetic clutch placed outside of said bottom of said front casing, wherein said electromagnetic clutch is coupled to said shaft.

3. A compressor of claim 2, wherein said bottom, said side wall, and a fixed scroll form a suction chamber, said rear cover and said fixed scroll form a discharge chamber, said fixed scroll has a discharge hole, said suction port penetrates into said suction chamber, said discharge port penetrates into said discharge chamber, and said refrigerant enters said suction chamber through said suction port, and is compressed by a movable scroll and said fixed scroll, discharged into the discharge chamber from said suction chamber through said discharge hole, and is discharged from said discharge chamber through said discharge port.

4. A compressor of claim 2, further comprising:

a first seal between said front casing and a fixed scroll, and a second seal between said front casing and said rear cover.

5. A compressor of claim 2, further comprising:

(e) a first seal mechanism placed between an inner circumference of said front casing and an outer circumference of a fixed scroll, and (f) a second seal mechanism placed between the inner circumference of said front casing and an outer circumference of said rear cover.

6. A compressor of claim 2, further comprising:

a space formed between an outer circumference of said rear cover and an inner circumference of said front casing, said rear cover has a hole formed in its outer circumference, and said refrigerant passes through said hole, said space, and said discharge port.

7. A compressor of claim 2, wherein said front casing has a cylindrical shape, and said front casing has a step so that a diameter of a first fitting portion of said front casing fitting to said rear cover may be larger than a diameter of a second fitting portion of said front casting fitting to a fixed scroll.

8. A compressor of claim 2, further comprising:

(e) a first seal mechanism placed between an inner circumference of said front casing and an outer circumference of a fixed scroll, (f) a second seal mechanism placed between the inner circumference of said front casing and an outer circumference of said rear cover, and (g) a rotation preventive mechanism incorporated in said front casing for preventing rotation and allowing swivel motion only by rotation of said shaft, wherein said bottom, said side wall, and said fixed scroll form a suction chamber, said rear cover and said fixed scroll form a discharge chamber, said fixed scroll has a discharge hole penetrating into said discharge chamber, said suction port penetrates into said suction chamber, said discharge port penetrates into said discharge chamber, and said refrigerant enters said suction chamber through said suction port, and is compressed by a movable scroll and said fixed scroll, discharged into the discharge chamber from said suction chamber through said discharge hole, and is discharged from said discharge chamber through said discharge port.

9. A compressor of claim 2, wherein said base is fixed to a vehicle.

* * * * *

UNITED STATES PATENT AND TRADEMARK OFFICE

CERTIFICATE OF CORRECTION

PATENT NO. : 6,171,085 B1
DATED : January 9, 2001
INVENTOR(S) : Iwasa

It is certified that error appears in the above-identified patent and that said Letters Patent is hereby corrected as shown below:

Column 8,
Line 7, after "cover" insert -- 2 --.

Signed and Sealed this

Eighth Day of January, 2002

*Attest:*

*Attesting Officer*

JAMES E. ROGAN
*Director of the United States Patent and Trademark Office*